United States Patent [19]

Friedrich et al.

[11] 4,075,978

[45] Feb. 28, 1978

[54] APPARATUS FOR HEATING A CONTAMINATED FEEDWATER FOR STEAM FLOODING

[75] Inventors: Jan L. Friedrich, Pompton Plains; Ronald L. Davies, Newton, both of N.J.

[73] Assignee: Foster Wheeler Energy Corporation, Livingston, N.J.

[21] Appl. No.: 725,616

[22] Filed: Sep. 22, 1976

[51] Int. Cl.[2] ..... F22B 1/08; F22D 1/28

[52] U.S. Cl. ..... 122/33; 122/441; 122/483

[58] Field of Search ..... 122/32, 33, 34, 441, 122/483

[56] References Cited

U.S. PATENT DOCUMENTS

| | | | |
|---|---|---|---|
| 1,768,448 | 6/1930 | Hartmann et al. | 122/33 |
| 1,784,426 | 12/1930 | Gleichmann | 122/33 |
| 2,881,741 | 4/1959 | Buri | 122/33 |
| 3,020,894 | 2/1962 | Rowand | 122/33 |

*Primary Examiner*—Kenneth W. Sprague

*Attorney, Agent, or Firm*—Marvin A. Naigur; John E. Wilson

[57] ABSTRACT

An apparatus for heating a fluid in which a vapor generator is provided which includes a furnace section for combusting a fuel and means to pass water in a heat exchange relation to the furnace section to convert the water to steam. A heat exchanger is provided in fluid flow communication with the furnace section for receiving the steam and for passing the steam in a heat exchange relation with the fluid to preheat the fluid. An additional heat exchanger is provided adjacent the furnace section for receiving the combustion gases from the furnace section and passing same in a heat exchange relation with the preheated fluid to apply additional heat to the fluid.

8 Claims, 2 Drawing Figures

APPARATUS FOR HEATING A CONTAMINATED FEEDWATER FOR STEAM FLOODING

BACKGROUND OF THE INVENTION

This invention relates to an apparatus for heating a fluid and more particularly to such an apparatus for heating contaminated water utilizing a vapor generator.

Many oil recovery techniques involve the injection of very large quantities of steam into the ground to facilitate the recovery of the oil. In many of these installations, water from conveniently located ponds, lakes, or the like, is passed through a vapor generator, or the like, to produce the steam at a relatively low cost.

However, the pond and lake water is often contaminated with salt and other type solids which, due to the high heat and pressures involved, will often plate out on the tubes of the steam generator. This, of course, causes tube failures and requires frequent cleaning and therefore is relatively expensive.

Although it is possible to treat the process water to clean it before introducing it to the vapor generator, this also involves relatively high additional expense.

SUMMARY OF THE INVENTION

It is, therefore, an object of the present invention to provide an apparatus for heating fluid, such as process water, in which tube failure is minimized and cleaning requirements are reduced.

It is a further object of the present invention to provide an apparatus of the above type in which process water may be utilized without the necessity of pretreating same to rid it of contaminants.

It is still a further object of the present invention to provide an apparatus of the above type in which the flow of process water through the main vapor generator is completely eliminated yet which enables the water to be heated by the heat from the vapor generator.

Toward the fulfillment of these and other objects, the apparatus of the present invention comprises a vapor generator including a furnace section for combusting a fuel and means to pass water in a heat exchange relation to the furnace section to convert the water to steam; first heat exchange means in fluid flow communication with the furnace section for receiving the steam; means for passing said fluid through the first heat exchange means in a heat exchange relation with said steam to preheat said fluid; second heat exchange means disposed adjacent the furnace section for receiving the combustion gases from said furnace section; and means for passing the preheated fluid through the heat exchange means to apply additional heat to the fluid.

DESCRIPTION OF THE PREFERRED EMBODIMENT

Figure 1:
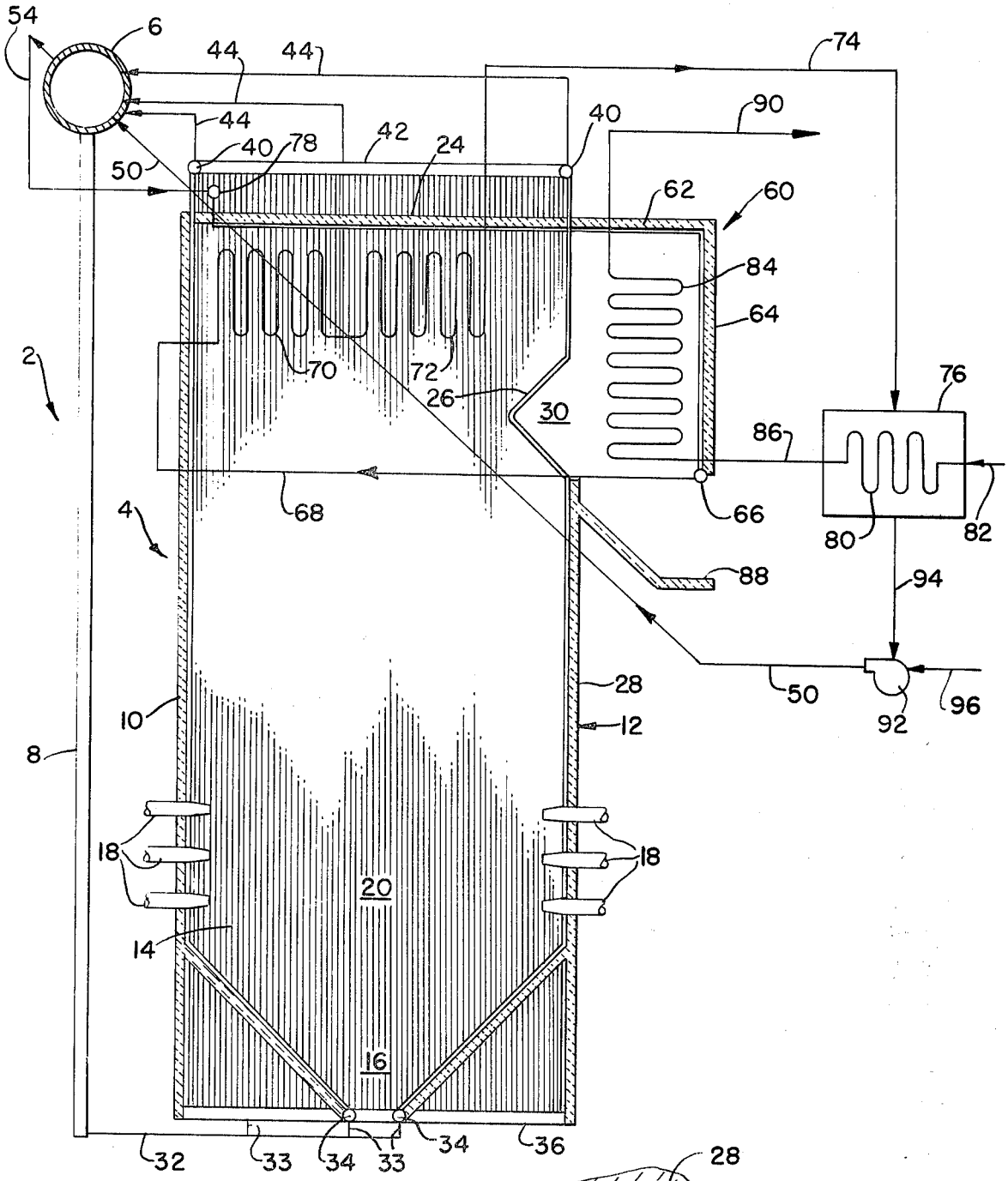
FIG. 1 is a partial sectional, partial schematic representation of the apparatus of the present invention.

Referring to FIG. 1, the reference numeral 2 refers in general to a natural circulation boiler which includes, in general, a vapor generator 4, a separation drum 6 disposed externally of the vapor generator 4, and a downcomer 8 connected between the drum 6 and the vapor generator 4.

The vapor generator 4 is in the form of a substantially gas-tight enclosure having a front wall 10, a rear wall 12 and two side walls, the back one of which is shown by the reference numeral 14.

The lower portions of the front wall 10 and the rear wall 12 are bent inwardly to form a hopper section 16. A plurality of burners are shown in general by the reference numeral 18 and extend through the front wall 10 only and/or the rear wall 12 to define a furnace section 20 in the interior of the enclosure. The upper portion of the furnace section 20 is closed off by a roof 24.

Figure 2:
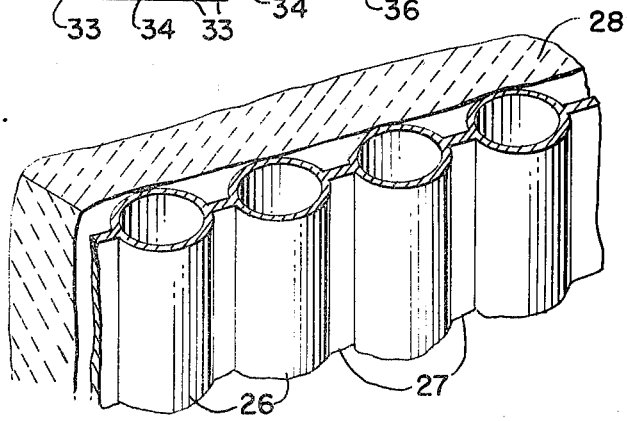
FIG. 2 is an enlarged, partial, perspective view of a portion of the apparatus of FIG. 1.

Each of the front wall 10, rear wall 12, side walls 14 and roof 24 is constructed and arranged in a manner shown in FIG. 2. In particular, a plurality of spaced, parallel, vertically extending tubes 26 are provided which have membranes, or fins, 27 extending from diametrically opposite external surfaces thereof. The fins 27 are welded to their respective tubes 26 and the fins 27 of adjacent tubes 26 are welded together along their lengths to form a gas-tight structure. An insulating material 28 extends adjacent the outer surfaces of the tubes for the complete length of the walls and roof thus formed.

Referring again to FIG. 1, it is noted that an upper portion of each tube 26 forming the rear wall 12 is bent inwardly and is not covered by insulating material 28 to form a gas pass 30. Although not clear from the drawings, it is understood that portions of the tubes 26 and/or their corresponding fins 27 forming this portion of the wall 12 are removed to permit combustion gases from the upper portion of the furnace section 20 to exit from the enclosure for reasons that will be described in detail later.

The lower end of the downcomer 8 is connected via a conduit 32 and branch conduits 33 to two lower headers 34 which communicate with the tubes 26 forming the front wall 10 and the rear wall 12. In a similar manner the conduit 32 and branch conduits 33 also connect the downcomer 8 to lower headers 36 communicating with the tubes of the side walls 14, with one such header being shown in FIG. 1.

The upper ends of the tubes 26 forming the walls 10 and 12 are connected in communication with upper headers 40, while the upper ends of the tubes 26 forming the side walls 14 are connected in communication with upper headers 42, with one of the latter being shown in FIG. 1. A plurality of conduits 44 connect the headers 40 and 42 to the drum 6 to pass the steam-water mixture formed as a result of passage of the water through the vapor generator 4 into the drum.

A conduit 50 receives water from a source to be described in detail later and passes same to the drum 6 which operates in a conventional manner to separate the steam received from the conduits 44 from the water. An outlet conduit 54 is connected to the drum 6 for passing the steam outwardly therefrom as will be described in detail later.

As a result of the foregoing, a conventional natural circulation operation is achieved with the separated water in the drum 6 exiting from the drum and passing through the downcomer 8 and the conduits 32 and 33 to the lower headers 34 and 36. The water then enters and passes upwardly through the tubes 26 of the walls 10, 12 and 14.

A mixture of fuel and air is discharged through the burners 18 into the furnace section 20 where it is combusted to generate heat and hot combustion gases which heat the water in the lower portions of the tubes 26 of the walls 10, 12 and 14. At least a portion of the water in the tubes 26 is thus converted to steam as it passes up the lengths of the walls 10, 12 and 14 by natural circulation. The steam-water mixture thus formed collects in the headers 40 and 42 and passes, via conduits 44, to the drum 6 where it is mixed with feed water entering the drum through the conduit 50. The steam and water are separated in the drum 6 and the water passes from the latter to the downcomer 8 for continuous circulation and heating in accordance with the foregoing.

A heat exchanger housing 60 is formed integral with the upper portion of the rear wall 12 of the vapor generator 4 and includes a roof portion 62 and an outer wall portion 64 which are also formed with a series of tubes 26 and insulation material 28 in the same manner as depicted in FIG. 2. The end portion of the roof 62 is attached to the roof 24 of the vapor generator 4 with the tubes 26 of the roof 62 being connected in communication with the tubes 26 of the roof 24, and with the tubes 26 of the wall 64 being formed integral with, or connected in communication with, the tubes 26 of the roof 62.

A header 66 is connected in communication with the lower ends of the tubes forming the wall 64 of the heat exchanger housing 60, and a conduit 68 connects the header with a pair of superheating sections 70 and 72 disposed in the upper, or radiant-convection, section of the vapor generator 4. The superheating sections 70 and 72 are formed by a series of tubes disposed in a serpentine relationship and extend in a heat exchange relation with the combustion gases rising to the upper section of the furnace section 20 of the vapor generator 4. After passing over the superheating sections 70 and 72, the combustion gases pass through the gas pass 30 and into the heat exchanger housing 60 for reasons to be described in detail later.

The superheating section 72 is connected via a conduit 74 to an external heat exchanger 76 which operates in a manner that will also be described in detail later.

The steam outlet conduit 54 extending from the drum 6 is connected to a header 78 which distributes the steam from the drum through the tubes 26 forming the roof 24 of the vapor generator 4 and therefore through the roof 62 and the wall 64 of the heat exchanger housing 60. The steam then collects in the header 66 and passes, via the conduit 68, through the superheating section 70 and 72 and, via the conduit 74, to the heat exchanger 76.

The heat exchanger 76 includes a coil 80 which receives contaminated process water from a pond, lake, or the like, via a conduit 82, so that the process water passes in a heat exchange relation with the steam entering the heat exchanger 76 via the conduit 74.

In order to apply additional heat to the process water, a heat exchange coil 84 is disposed in the heat exchanger housing 60, and a conduit 86 connects the latter coil with the coil 80 of the heat exchanger 76. As a result of the foregoing, the process water from the conduit 82 passes in a heat exchange relation with both the steam from the vapor generator 4 passing through the heat exchanger 76 and combustion gases passing through the heat exchanger housing 60.

The combustion gases from the heat exchanger housing 60 exit through an outlet 88 formed by an extended portion of the refractory material 28 supported by non-heat-exchange platework (not shown) for passage onto an air preheater or the like (not shown).

A conduit 90 is connected to the outlet end of the coil 84 for passing the heated process water externally of the system for use in any type of steam flooding, or the like.

A pump 92 receives the condensed steam from the heat exchanger 76, via a conduit 94, and, in addition when make-up water is required, receives relatively pure feed water from an external source via a conduit 96. The outlet of pump 92 is connected to the conduit 50 for supplying the condensed steamfeed water mixture to the drum 6.

In operation the relatively cool process water from the conduit 82 is passed through the heat exchanger 76 in a heat exchange relation with the steam passing through the latter heat exchanger which raises the temperature of the process water to a predetermined level. The preheated water is then passed, via line 86, to and through the heat exchanger housing 60 where the combustion gases passing through the latter housing applies additional heat to the process water to convert it to steam before it is passed externally of the system via line 90.

The condensed steam from the heat exchanger 76 and the make-up feed water from the conduit 96 are pumped through the conduit 50 to the drum 6 where they mix with the steam from the conduits 44. The drum 6 operates to separate the water from the steam and distribute the water to the downcomer 8 and the steam to the conduit 54, as described above.

It is thus seen that several advantages result from the apparatus of the present invention. For example, the process water is heated to a satisfactory level without introducing same into or through the main vapor generator 4. As a result, the contaminants including sodium chloride, oil, and the like, contained in the process water are isolated from the circuitry of the vapor generator thus minimizing its down time for repairs, cleaning, and the like. Also, the heat exchange coils 80 and 84 that are subjected to the contaminated process water can be easily cleaned without necessitating a stoppage of the main vapor generator 4 which significantly reduces the down time of the entire system since the quality of process water flowing through the coils 80 and 84 may be varied from time to time to facilitate clean up of this circuitry.

It is understood that several variations may be made in the foregoing without departing from the scope of the invention. For example, the present invention is not limited to use with a natural circulation boiler but rather, other types of vapor generating equipment may be used such as a once-through unit or the like. Also, the use of the steam generated as a result of the present apparatus is not limited to the use of steam flooding but can be used in any other manner compatible with the present invention.

Of course, variations of the specific constructions and arrangement of the apparatus disclosed above can be made by those skilled in the art without departing from the invention as defined in the appended claims.

We claim:

1. An apparatus for heating a fluid comprising a vapor generator including a furnace section for combusting a fuel and means to pass water in a heat exchange relation to said furnace section to convert said water to steam; first heat exchange means disposed externally of said vapor generator in fluid flow communication with said furnace section for receiving said steam; said first heat exchange means including coil means through which said fluid is passed, said steam passing over said coil means to preheat said fluid; second heat exchange means disposed adjacent said furnace section for receiving the combustion gases from said furnace section; and means for passing said preheated fluid through said second heat exchange means to apply additional heat to said fluid.

2. The apparatus of claim 1, wherein said second heat exchange means includes a plurality of tubes mounted adjacent one wall of said vapor generator and adapted to receive said steam from said furnace section before it is passed to said first heat exchange means.

3. The apparatus of claim 2, wherein said second heat exchange means is disposed adjacent the upper portion of one wall of said vapor generator, with said wall having at least one opening formed therein to permit passage of said combustion gases from said furnace section to said second heat exchange means.

4. The apparatus of claim 3, wherein said second heat exchange means includes coil means disposed in said housing for passing said preheated fluid through said housing, with said combustion gases passing over said coils for applying said additional heat to said preheated fluid.

5. The apparatus of claim 1, wherein the walls of said vapor generator consist of a plurality of finned tubes connected together to form a substantially gas-tight structure, with a portion of said tubes being bent inwardly to permit passage of said combustion gases to said second heat exchange means.

6. The apparatus of claim 1, wherein said vapor generator further comprises a separation drum for receiving the water after passing through said tubes, and a nonheated downcomer connecting said drum to the lower ends of said tubes for circulating the water in said drum back through said tubes.

7. The apparatus of claim 6, further comprising superheater means disposed in said vapor generator for receiving the steam from said drum and passing same through said furnace section before passing same to said first heat exchange means.

8. The apparatus of claim 1, wherein said fluid is a contaminated fluid and is utilized for steam flooding.

* * * * *